US009402514B2

(12) United States Patent
Liu

(10) Patent No.: US 9,402,514 B2
(45) Date of Patent: Aug. 2, 2016

(54) GLASS WIPER

(75) Inventor: Wengao Liu, Ningbo (CN)

(73) Assignee: Ningbo Beari Plastic Products & Electric Appliance Co., Ltd., Ningbo (CN)

( * ) Notice: Subject to any disclaimer, the term of this patent is extended or adjusted under 35 U.S.C. 154(b) by 205 days.

(21) Appl. No.: 14/373,186

(22) PCT Filed: Feb. 7, 2012

(86) PCT No.: PCT/CN2012/000149

§ 371 (c)(1),
(2), (4) Date: Aug. 14, 2014

(87) PCT Pub. No.: WO2013/106956

PCT Pub. Date: Jul. 25, 2013

(65) Prior Publication Data

US 2014/0366296 A1 Dec. 18, 2014

(30) Foreign Application Priority Data

Jan. 19, 2012 (CN) ..... 2012 1 0016736

(51) Int. Cl.
*A47L 1/08* (2006.01)
*A47L 13/08* (2006.01)
*A47L 1/06* (2006.01)

(52) U.S. Cl.
CPC ... *A47L 1/08* (2013.01); *A47L 1/06* (2013.01); *A47L 13/08* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 1,498,246 | A * | 6/1924 | Spencer | A47L 1/08 | 15/220.1 |
| 4,455,705 | A * | 6/1984 | Graham | A47L 13/08 | 15/121 |
| 4,776,716 | A * | 10/1988 | Huang | A47L 1/08 | 15/172 |
| 5,271,682 | A * | 12/1993 | Realdon | A47L 1/08 | 401/146 |
| 2004/0177461 | A1* | 9/2004 | Ajluni | A47L 1/06 | 15/121 |
| 2009/0025168 | A1* | 1/2009 | DeRoma | A47L 1/15 | 15/220.1 |

* cited by examiner

*Primary Examiner* — David Walczak
(74) *Attorney, Agent, or Firm* — Wing Law Firm, Inc.

(57) ABSTRACT

A windows wiper, which includes a base with a transversal arm and a vertical handle; a wiping board; and a bottom board, wherein the wiping board is able to rotate until the upper surface of the transversal arm rests against the bottom surface of the wiping board and the scraping edge extends forward beyond the surrounding edge of the wiping board. The windows wiper of the present invention has the two functions of scraping and wiping. The number of components of the windows wiper is small, and the configuration is simple too. Further more, when the scraping edge is used to scrape the glass or the wiping towel on the wiping board is used to wipe the glass, the direction of operation is parallel to the vertical portion of the base, which makes the operation convenient.

9 Claims, 6 Drawing Sheets

GLASS WIPER

RELATE APPLICATIONS

This application is a national phase entrance of and claims benefit to PCT Application for a windows wiper, PCT/CN2012/000149, filed on Feb. 7, 2012, which claims benefit to Chinese Patent Application 201210016736.9, filed on Jan. 19, 2012. The specifications of both applications are incorporated here by this reference.

FIELD OF THE INVENTION

The present invention relates to a kind of cleaning apparatus for daily use, in particular, to a kind of windows wiper which is used for windows cleaning.

DESCRIPTION OF THE PRIOR ART

There are mainly two kinds of traditional windows wipers: One is the window brush which consists of a brush holder and a wiping towel fixed on the brush holder; and the other is a scraping tool with a flexible adhesive tape mainly used for scraping and cleaning the glass, e.g. a Chinese patent CN200998226Y(patent No.: ZL200720004365.7) with the title "A Windows wiper", and another Chinese patent CN200960089Y(patent No.: ZL200620108901.3) with the title "A Hydro jet Window Brush". When cleaning the glass, the wiping towel and the scraping tool with the flexible adhesive tape are used together, with a sprinkling can for spraying water or cleaning fluid equipped.

The apparatus disclosed in the preceding patents only functions in wiping, that is, the operator needs to carry along three tools independent from each other when wiping the glass. It is not only inconvenient but also probable for the operator to forget carrying one of the tools, resulting in low work efficiency.

As an improvement, a glass cleaning tool, with the functions of both scraping and wiping, is therefore invented, e.g. a Chinese patent CN2794409Y(patent No.: ZL200520101846.0) with the title "A Double-used Window Brush for Water Draining", which comprises a brush holder provided with a configuration of hollow middle part. Such configuration is the hole for water draining that can be connected to the water source. Two supporting legs are extended from the holder, with a supporting shaft suited by a wiping towel fixed on one and a wiper blade installed on the other. The wiper blade is clamped on the wiper blade seat paralleled with the supporting shaft through the fixation of press blade and supporting legs. The utility model can be connected to the water source with the function of wiping and scraping for convenient use.

During the supporting shaft with a wiping towel is used by the apparatus for cleaning the glass, the brush holder in the hand should be leaned with a certain angle to avoid the interference against the glass by the wiper blade. As the wiping angle between the brush holder and the glass and that between the supporting shaft and the glass are not parallel, the hands will feel uncomfortable. In addition, it is inconvenient and unreasonable to connect any external water pipe and tap for water spraying.

In conclusion, the available glass wiping tools with double uses can be further improved.

SUMMARY OF THE INVENTION

It is an object of the present invention to provide a windows wiper with the functions of scraping and wiping. When these two functions are altered, the angles of the windows wiper can be switched, the windows wiper has equally comfortable operation in each kind of function, and the windows wiper has a reasonable configuration design.

For achieving the above stated object, the windows wiper comprises: a base with a transversal arm and a vertical handle, the transversal arm having a bottom surface, an upper surface, and a front end with a shaft; a wiping board for holding a wiping towel, the wiping board having an upper surface, a bottom surface, and a middle portion rotatably connected to the front end of the transversal arm through the shaft, the wiping board has a surrounding edge; and a bottom board connected to the bottom surface of the wiping board, the bottom board having a front end with a scraping edge, wherein the wiping board is able to rotate relative to the shaft until the upper surface of the transversal arm rests against the bottom surface of the wiping board and the scraping edge extends forward beyond the surrounding edge of the wiping board.

As a preference, the bottom board slides forward and backward relatively to the wiping board and is limited under the wiping board in a forward position and a backward position, when the bottom board slides forward relatively to the wiping board and is limited in the forward position, the scraping edge extends forward beyond the wiping board, when the bottom board slides backward relatively to the wiping board and is limited in the backward position, the scraping edge retracts backward hiding under the wiping board. Accordingly, when the scraping edge is required for scraping the glass, the scraping edge slides forward to be limited in the forward position and beyond the surrounding edge of the wiping board; when the wiping towel covering on the wiping board is required for wiping the glass, the scraping edge slides backward to be limited in a backward position and retracts backward hiding under the wiping board. In this way, no interfere will be caused by the scraping edge to the glass when wiping.

As a preference, the wiping board is provided with two C-shaped through holes, each C-shape through hole has an open mouth and both open mouths face a same direction, the two C-shaped through holes are disposed parallel to each other, and the bottom board is provided with two locating columns extending away from the bottom board, each locating column passes through a corresponding C-shaped through hole and connects with a stopping element, the two locating columns and the corresponding stopping elements enable the bottom board to slide under the wiping board, each locating column moves along a channel in a corresponding C-shaped through hole, when each locating column moves to a front portion of a corresponding C-shaped through hole, the scraping edge of the bottom board extends forward beyond the surrounding edge of the wiping board, when each locating column moves to a rear portion of a corresponding C-shaped through hole, the scraping edge of the bottom board will retract backward hiding under the wiping board. Such configuration is convenient to move and limit the wiping board to a certain position. In operation, push the wiping board to make each locating column move along a channel in a corresponding C-shaped through hole, when each locating column moves to a front portion or a rear portion of a corresponding C-shaped through hole, each locating column is blocked by the front side or rear side of the corresponding C-shaped through hole to complete the position limitation, which is quite convenient and practical.

As a preference, the upper surface of the wiping board is provided with two recesses, each C-shaped through hole is located in one recess, and the each stopping element is located in one recess. As the stopping elements are hided in the corresponding recess, the stopping elements will not extend outside the upper surface of the wiping board, which ensures that the wiping towel will be held upward by the stopping elements and the surface of the wiping towel can be kept smooth. The stopping elements can be either locating nuts or rings.

As a preference, a torsional spring is disposed round the shaft, the torsional spring exerts force to make the wiping board turning backward and being horizontal. The torsional spring has the following two functions: firstly, the torsional spring can make the wiping board to be horizontal, so that the scraping edge can be kept scrapping the glass surface all the time and the scraping edge can scrap and wipe the glass in a more effective way; secondly, the torsional spring can keep the wiping board stuck to a glass surface, so that the wiping towel can wipe the glass more effectively.

As a preference, the bottom surface of the wiping board is provided with an inserting portion extending away from the wiping board, the front end of the transversal arm of the base defines a gap for receiving the inserting portion, the inserting portion is pivoted to the base through the shaft. It is a detail configuration of a wiping board being pivoted to the base. Such a rotating connection is assembled simply, and it can be achieved by other available ways.

As a preference, one end of the torsional spring rests against the bottom surface of the transversal arm and other end of the torsional spring is inserted into an inserting hole on the inserting portion. As one end of the torsional spring is inserted into the inserting hole on the inserting portion, the end of the torsional spring can move along with the wiping board.

As a preference, a wiping towel covers the wiping board, which is convenient for the wiping board to hold the wiping tower.

As a preference, the vertical handle engages an external sprayer. The sprayer is used for providing cleaning fluid or water for the glass without extra connection to water source. In addition, the sprayer can also be used as a grip of the windows wiper for convenient operation.

As a preference, the vertical handle has a bottom end with an annular locating hole which is installed around an opening of the sprayer and limited by a lid on the opening of the sprayer. Such configuration is convenient to engage the base with the sprayer.

Compared with the prior art, in the present invention, the windows wiper is provided with the scraping edge and the wiping board with the fixed wiping towel, which may perform the functions of both scraping and wiping at the same time; in addition, the windows wiper has a few components, thereby resulting in a simple and reasonable configuration; when the wiping board turns backward to the horizontal state, the upper surface of the transversal arm rests against the bottom surface of the wiping board, when the bottom surface of the wiping board is turned away from the upper surface of the transversal arm, the wiping towel on the wiping board can be used for wiping the glass surface, the vertical arm of the base can be held by the operator so that the action direction can be basically parallel with the vertical arm of the base when using the scraping edge to scrap the glass or using the wiping towel in the wiping board to wipe, thereby resulting in a convenient operation; besides, the wiping board can be rotated relative to the base. As the angle between the glass and arms will keep changing during wiping the glass with the wiping towel, the shaft can ensure that the wiping board will keep stuck to the glass, regardless of the angle change of the arms, avoiding tiredness on wrists. If the windows wiper has no shaft, the wrists should be rotated to keep the wiping board stuck to the glass which will cause tiredness on wrists.

DETAILED DESCRIPTION OF THE PREFERRED EMBODIMENT

To enable a further understanding of the innovative and technological content of the invention herein refer to the detailed description of the invention and the accompanying drawings below:

FIG. 1 to FIG. 10 show a preferred embodiment of the present invention.

Figure 10:
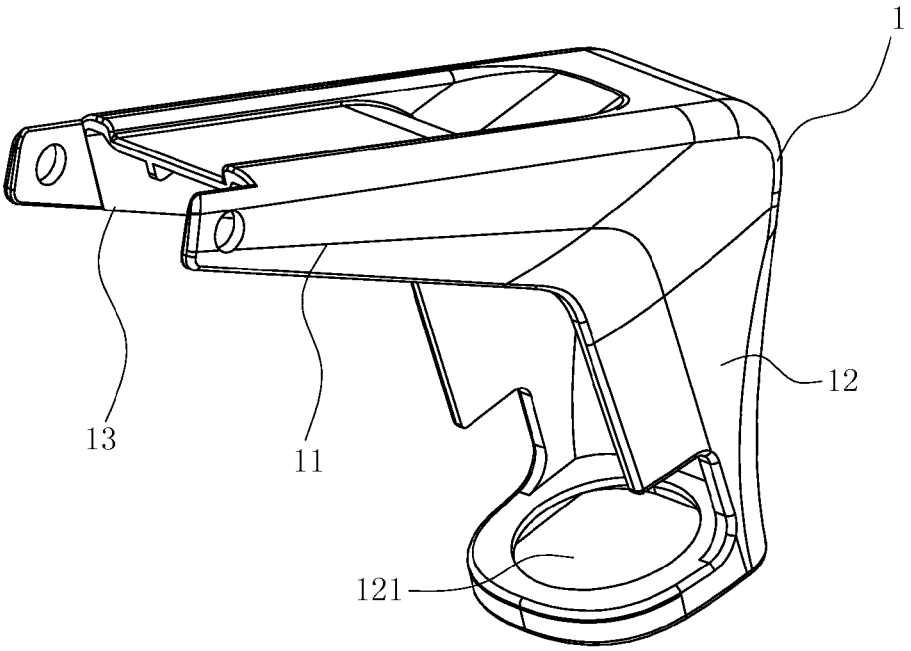
FIG. 10 is a perspective view of a base of the windows wiper in accordance with the embodiment of the present invention.

The windows wiper comprises:

a base 1 convenient to hold with hands, as shown in FIG. 10, being L-shaped and having a transverse arm 11 and a vertical handle 12.

A wiping board 2 used for holding a wiping towel 9 is rectangular in shape. The wiping towel 9 covers the wiping board 2. The wiping board 2 has a middle portion rotatably connected to the front end of the transversal arm 11 through the shaft 3. The bottom surface of the wiping board 2 is provided with an inserting portion 23 extending away from the wiping board 2, the front end of the transversal arm 11 of the base 1 defines a gap 13 for receiving the inserting portion 23, the inserting portion 23 is pivoted to the base 1 through the shaft 3. Both ends of the shaft 3 are supported on the walls at both sides of the gap 13. When the wiping board 2 is rotated backward to the horizontal state, the wiping board 2 cannot be rotated further backward after the bottom surface of the wiping board 2 contacts the upper surface of the transverse arm 11. Therefore, the wiping board 2 will appear to be horizontal when the upper surface of the transversal arm 11 rests against the bottom surface of the wiping board 2.

A torsional spring 7 is disposed round the shaft 3 with one end resting against the bottom surface of the transversal arm 11 and the other end inserted into an inserting hole 231 on the inserting portion 23, so as to make the wiping board 2 turning backward and being horizontal. In this way, the scraping edge can be kept over the wiped glass surface, and be able to scrape and wipe the glass more effectively. When the bottom surface of the wiping board 2 is turned away from the upper surface of the transversal arm to the vertical state, the torsional spring 7 can keep the wiping board 2 stuck to a glass surface all the time.

Figure 7:
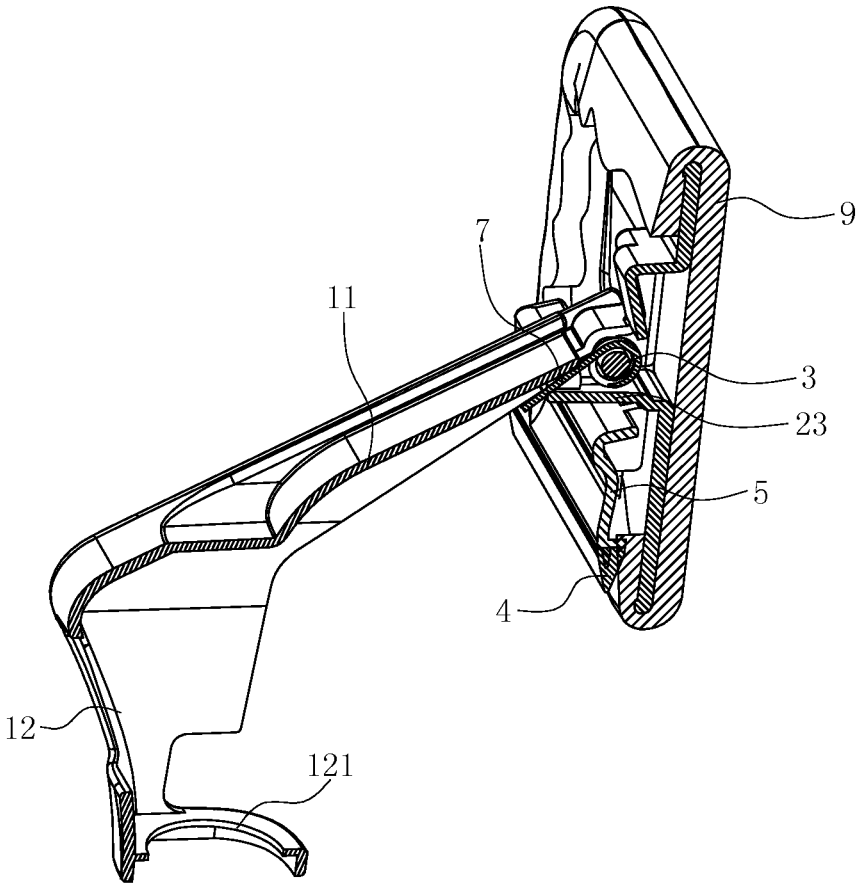
FIG. 7 is a perspective view of the windows wiper of FIG. 6 without the sprayer.
Figure 8:
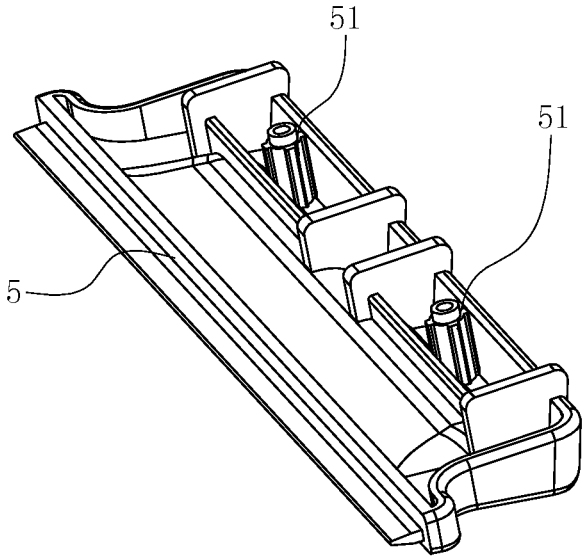
FIG. 8 is a perspective view of a bottom board of the windows wiper in accordance with the embodiment of the present invention.
Figure 9:
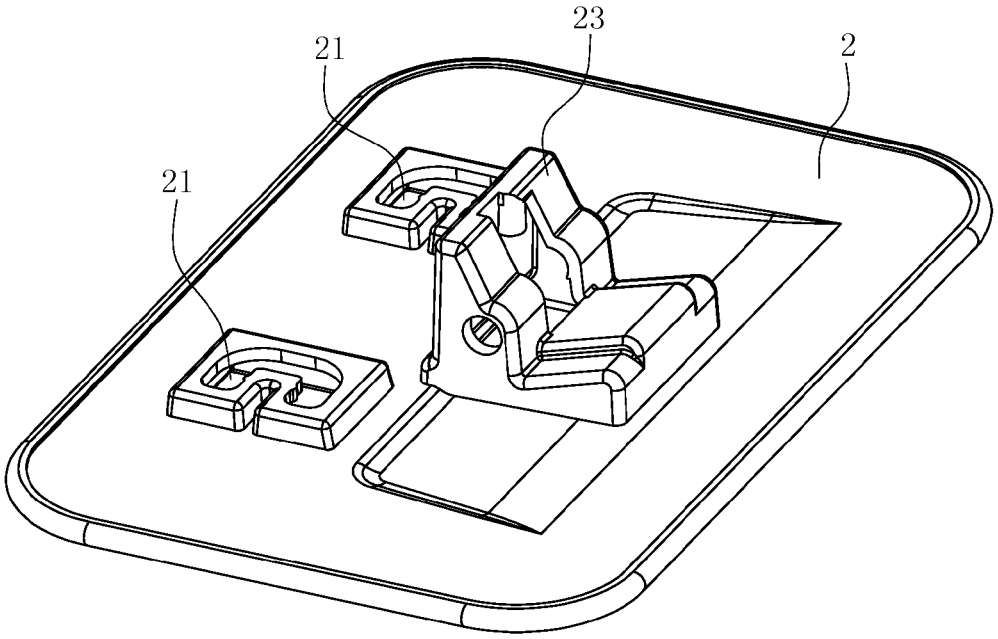
FIG. 9 is a perspective view of a wiping board of the windows wiper in accordance with the embodiment of the present invention.

As shown in FIG. 7, a bottom board 5 connected to the bottom surface of the wiping board 2, the bottom board 5 having a front end with a scraping edge 4, the wiping board 2 is able to rotate relative to the shaft 3 until the upper surface of the transversal arm 11 rests against the bottom surface of the wiping board and the scraping edge 4 extends forward beyond the surrounding edge of the wiping board 2; the bottom board 5 slides forward and backward relatively to the wiping board 2 and is limited under the wiping board 2 in a forward position and a backward position, when the bottom board 5 slides forward relatively to the wiping board 2 and is limited in the forward position, the scraping edge 4 extends forward beyond the wiping board 2, when the bottom board 5 slides backward relatively to the wiping board 2 and is limited in the backward position, the scraping edge 4 retracts backward hiding under the wiping board 2.

Figure 3:
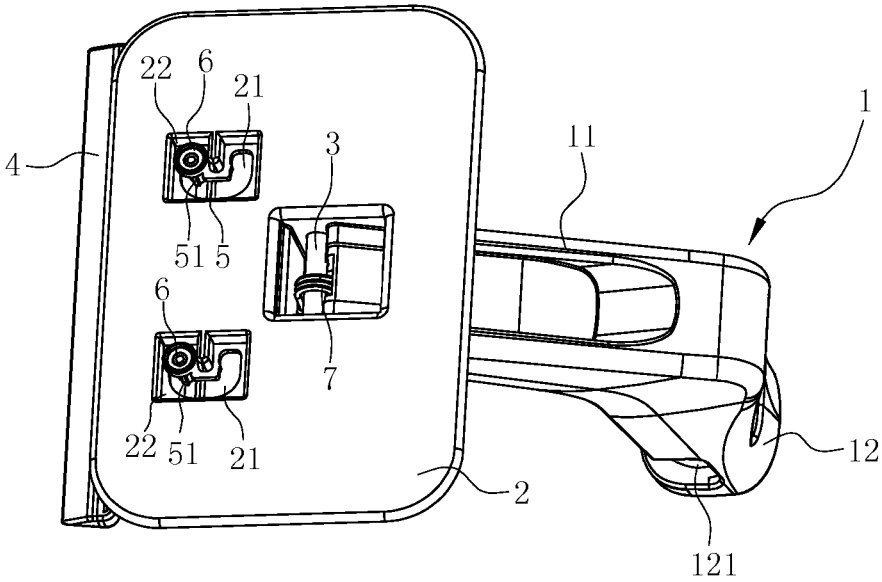
FIG. 3 is a perspective view of the windows wiper of FIG. 2 when the bottom board slides forward showing the locating columns in the front portion of the C-shaped through hole.
Figure 4:
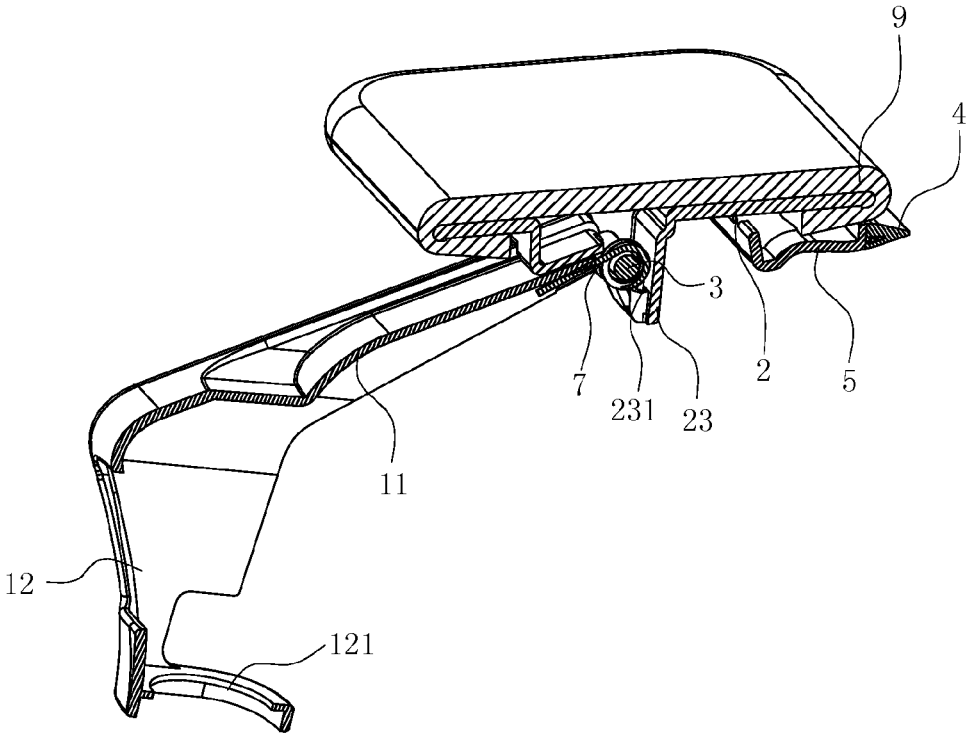
FIG. 4 is a sectional view of the windows wiper of FIG. 2 with the wiping towel covering the wiping board.
Figure 5:
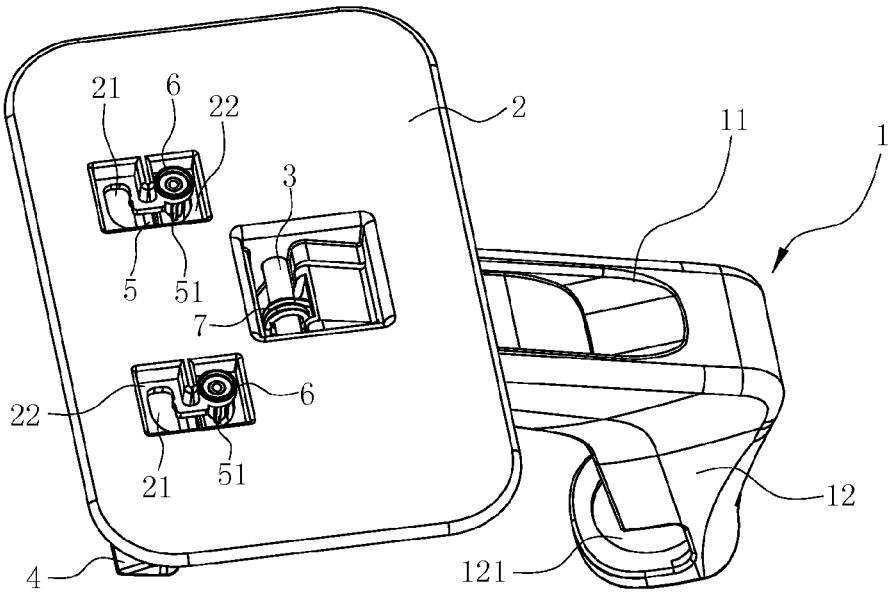
FIG. 5 is a perspective view of the windows wiper of FIG. 2 when the bottom board slides backward showing the locating columns in the rear portion of the C-shaped through hole.

As shown in FIGS. 3 and 4, the wiping board 2 is provided with two C-shaped through holes 21, each C-shape through hole has an open mouth and both open mouths face a same direction, the two C-shaped through holes 21 are disposed parallel to each other, and the bottom board 5 is provided with two locating columns 51 extending away from the bottom board, each locating column passes through a corresponding C-shaped through hole 21 and connects with a stopping element 6, the two locating columns and the corresponding stopping elements enable the bottom board 5 to slide under the wiping board 2, the stopping element 6 can be either a locating nut or a locating ring. Each locating column 51 moves along a channel in a corresponding C-shaped through hole 21, when each locating column 51 moves to a front portion of a corresponding C-shaped through hole 21, the scraping edge 4 of the bottom board 5 extends forward beyond the surrounding edge of the wiping board 2, when each locating column 51 moves to a rear portion of a corresponding C-shaped through hole 21, the scraping edge 4 of the bottom board 5 will retract backward hiding under the wiping board 2.

The upper surface of the wiping board 2 is provided with two recesses 22, each C-shaped through hole 21 is located in one recess 22, and the each stopping element 6 is located in one recess 22.

Figure 1:
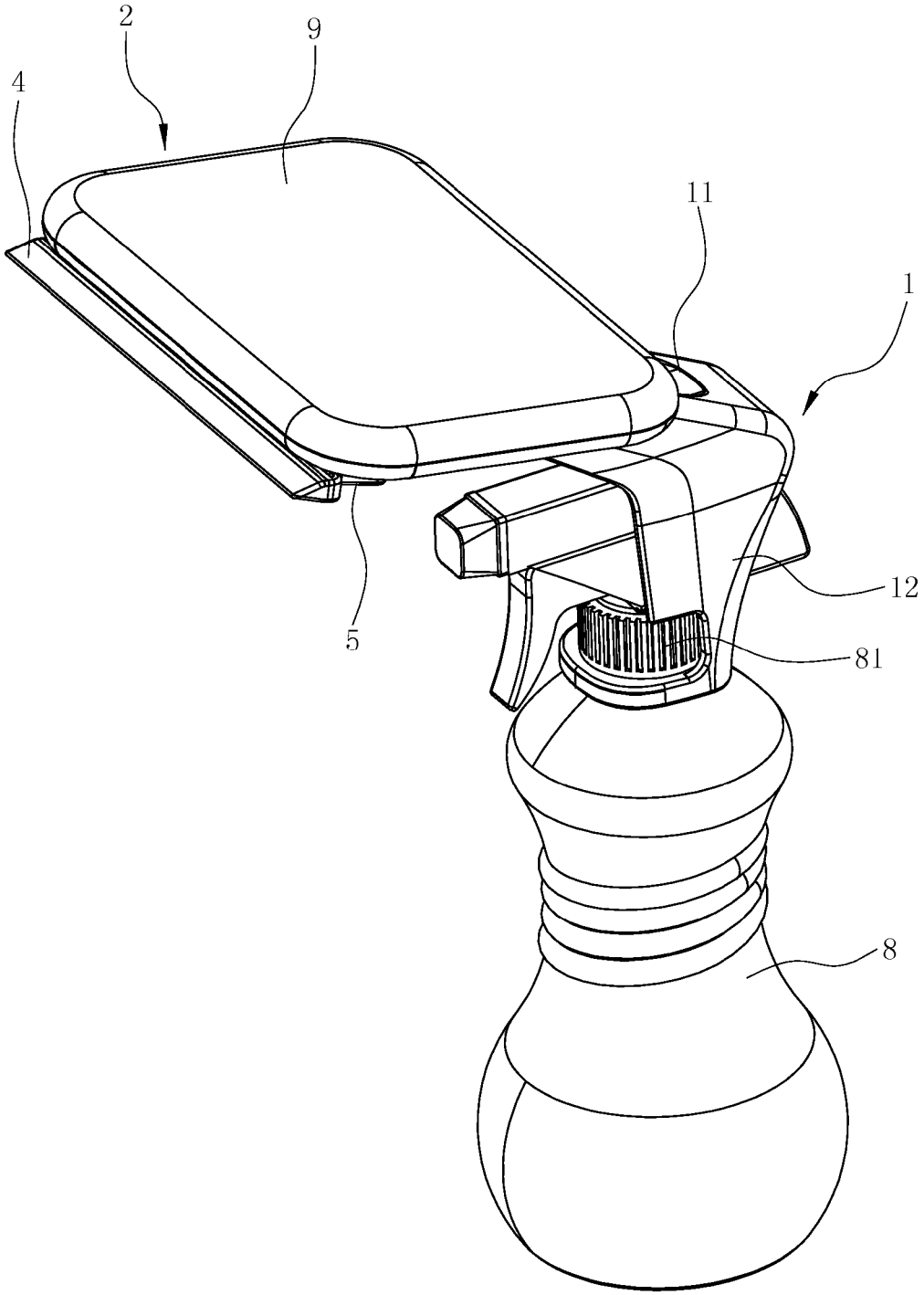
FIG. 1 is a perspective view of a windows wiper in accordance with the embodiment of the present invention when the wiping board is in horizontal state.
Figure 2:
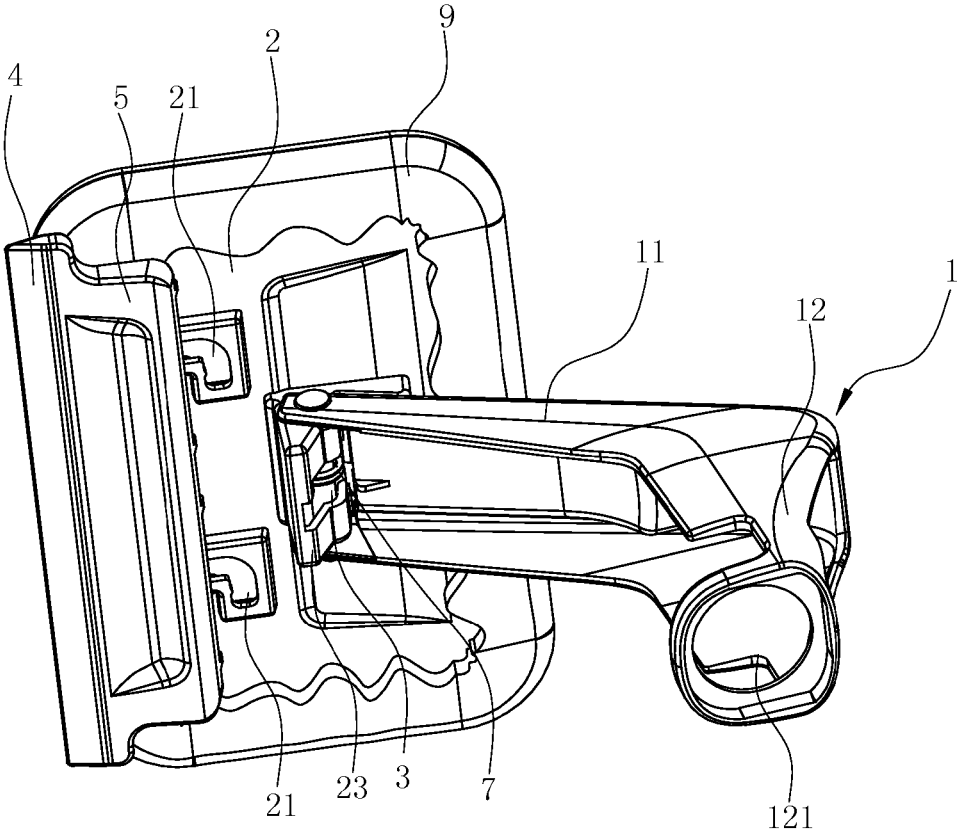
FIG. 2 is a perspective view of the windows wiper of FIG. 1 without the sprayer.

As shown in FIGS. 1 and 7, the vertical handle 12 engages an external sprayer 8. The vertical handle 12 has a bottom end with an annular locating hole 121 which is installed around an opening of the sprayer 8 and limited by a lid 81 on the opening of the sprayer 8.

The procedure for using the present invention is as follows:

As shown in FIGS. 1-4, when the scraping edge is required to be used for scraping the glass, the bottom board slides forward relative to the wiping board; each locating column 51 moves to a front portion of a corresponding C-shaped through hole 21 and is limited in a forward position, the scraping edge 4 of the bottom board 5 extends forward beyond the surrounding edge of the wiping board 2; and then the glass should be sprayed with water using the sprayer, the torsional spring exerts force to make the wiping board 2 turning backward and being horizontal, the sprayer should be held in the hand to scrape the glass from top to bottom. The bottom surface of the wiping board 2 cannot rotate further backward owing that the upper surface of the transversal arm 11 rests against the bottom surface of the wiping board 2, so that the glass can be scraped successfully.

Figure 6:
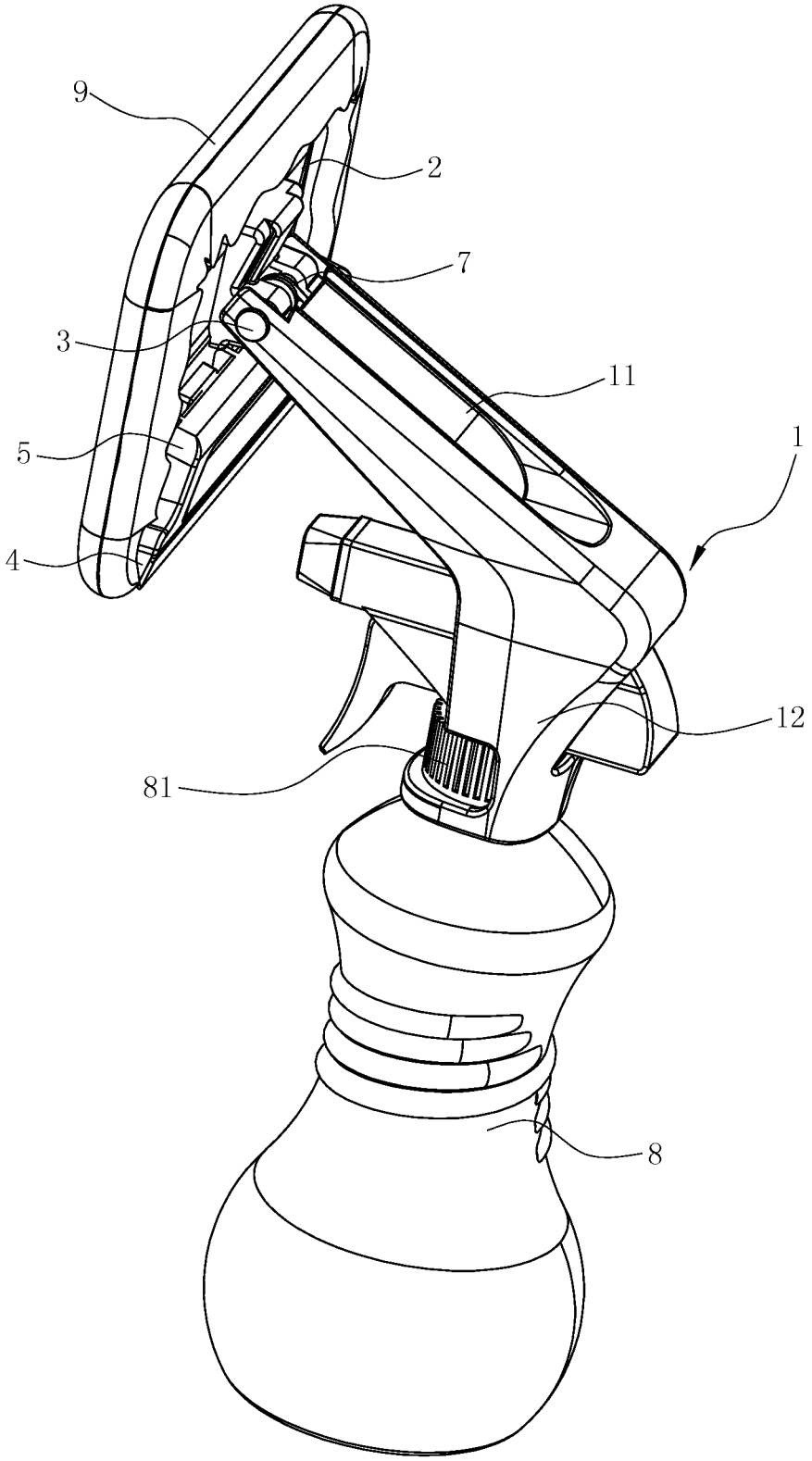
FIG. 6 is a perspective view of the windows wiper of FIG. 1 when the wiping board is in vertical state.

As shown in FIGS. 6 and 7, after the scraping is finished, the wiping towel can be used for wiping the glass. The bottom board slides backward relatively to the wiping board, each locating column 51 moves to a rear portion of a corresponding C-shaped through hole 21 and is limited in the backward position, the scraping edge 4 retracts backward hiding under the wiping board 2; keep the wiping board 2 stuck to a glass surface, the sprayer should be held and rotated through 90 degrees with the wiping board kept stuck to the wiped glass surface all the time under the action of the torsional spring, so that the glass can be wiped successfully.

The invention claimed is:

1. A windows wiper comprising:

a base with a transversal arm and a vertical handle, the transversal arm having a bottom surface, an upper surface, and a front end with a shaft;

a wiping board for holding a wiping towel, the wiping board comprises an upper surface, a bottom surface, and a middle portion rotatably connected to the front end of the transversal arm through the shaft, the wiping board has a surrounding edge; and a bottom board connected to the bottom surface of the wiping board, the bottom board having a front end with a scraping edge, wherein the wiping board is able to rotate relative to the shaft until the upper surface of the transversal arm rests against the bottom surface of the wiping board and the scraping edge extends beyond the surrounding edge of the wiping board, and the bottom board slides forward and backward relatively to the wiping board, when the bottom board slides forward relatively to the wiping board, the scraping edge extends beyond the wiping board, when the bottom board slides backward relatively to the wiping board, the scraping edge retracts backward hiding under the wiping board.

2. The windows wiper of claim 1, wherein the wiping board is provided with two C-shaped through holes, each C-shape through hole has an open mouth and both open mouths face a same direction, the two C-shaped through holes are disposed parallel to each other, and the bottom board is provided with two locating columns extending away from the bottom board, each locating column passes through a corresponding C-shaped through hole and connects with a stopping element, the two locating columns and the corresponding stopping elements enable the bottom board to slide under the wiping board, each locating column moves along a channel in a corresponding C-shaped through hole, when each locating column moves to a front portion of a corresponding C-shaped through hole, the scraping edge of the bottom board extends forward beyond the surrounding edge of the wiping board, when each locating column moves to a rear portion of a corresponding C-shaped through hole, the scraping edge of the bottom board will retract backward hiding under the wiping board.

3. The windows wiper of claim 2, wherein the upper surface of the wiping board is provided with two recesses, each C-shaped through hole is located in one recess, and the each stopping element is located in one recess.

4. The windows wiper of claim 1, wherein a torsional spring is disposed round the shaft, the torsional spring exerts force to rotate the wiping board around the shaft, when the bottom surface of the wiping board is turned away from the upper surface of the transversal arm, the torsional spring can keep the wiping board stuck to a glass surface all the time.

5. The windows wiper of claim 4, wherein the bottom surface of the wiping board is provided with an inserting portion extending away from the wiping board, the front end of the transversal arm of the base body defines a gap for receiving the inserting portion, the inserting portion is pivoted to the base body through the shaft.

6. The windows wiper of claim 5, wherein one end of the torsional spring rests against the bottom surface of the transversal arm and other end of the torsional spring is inserted into an inserting hole on the inserting portion.

7. The windows wiper of claim 1, wherein a wiping towel covers the wiping board.

8. The windows wiper of claim 1, wherein the base further comprises a vertical portion for engaging an external sprayer.

9. The windows wiper of claim 8, wherein the vertical portion has a bottom end with an annular locating hole which is installed around an opening of the external sprayer and limited by a lid on the opening of the external sprayer.

* * * * *